United States Patent [19]

van der Walt et al.

[11] 4,423,411

[45] Dec. 27, 1983

[54] IONIZATION TYPE FIRE DETECTOR

[75] Inventors: Nicolaas T. van der Walt, Meredale; Bernardus J. Bout, Walkerville; Timothy J. Newington, Johannesburg, all of South Africa

[73] Assignee: Crucible Society Anonyme, Luxembourg, Luxembourg

[21] Appl. No.: 298,804

[22] Filed: Sep. 2, 1981

Related U.S. Application Data

[63] Continuation of Ser. No. 96,009, Nov. 20, 1979, abandoned.

[30] Foreign Application Priority Data

Nov. 20, 1978 [ZA] South Africa ..... 78/6519

[51] Int. Cl.[3] ..... G08B 17/10

[52] U.S. Cl. ..... 340/629; 250/381

[58] Field of Search ..... 340/629; 250/381, 385

[56] References Cited

U.S. PATENT DOCUMENTS

| | | | |
|---|---|---|---|
| 2,954,474 | 9/1960 | Lawrence | 340/629 X |
| 3,676,678 | 7/1972 | Takahashi | 340/629 X |
| 3,795,904 | 3/1974 | Beyersdorf et al. | 340/629 |
| 3,964,036 | 6/1976 | Adachi et al. | 340/629 X |

*Primary Examiner*—John W. Caldwell, Sr.
*Assistant Examiner*—Daniel Myer

[57] ABSTRACT

A single chamber ionization-type fire detector. The ionization current is directly amplified to provide a usable analogue signal by means of an operational amplifier which has a minimal effect in the ionization current. The operational amplifier is simultaneously employed to maintain a constant potential difference in the chamber so that the ionization current is not subjected to a fluctuating voltage. The amplified analogue signal drives a recorder and through analysis of the recorder output genuine fire alarm conditions can be distinguished from false alarm conditions.

7 Claims, 1 Drawing Figure

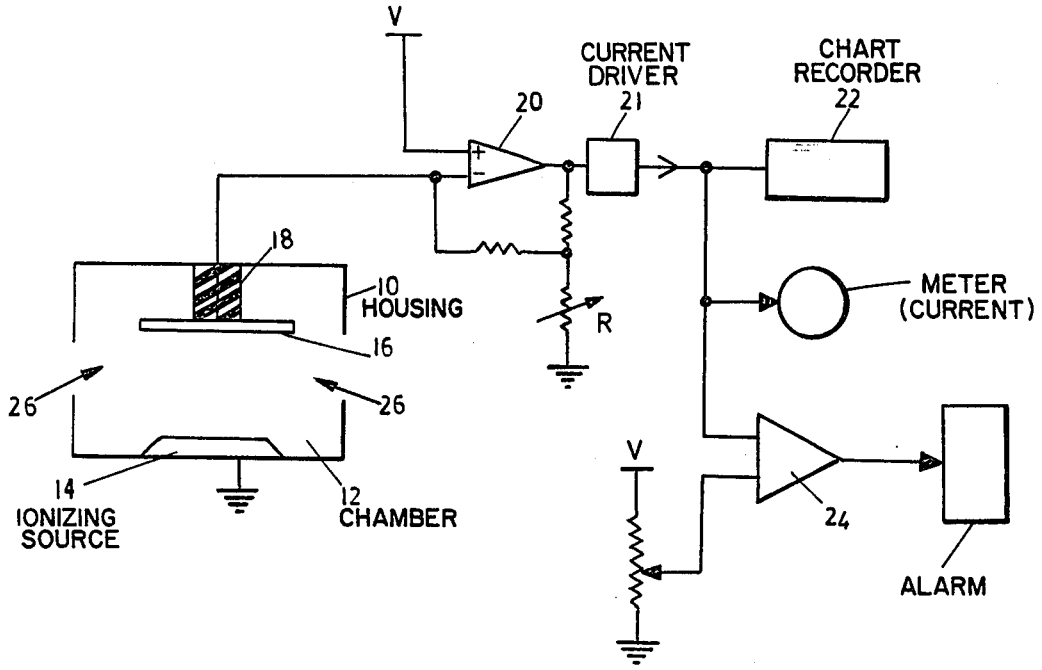
V
CURRENT DRIVER
21
CHART RECORDER
22
20
18
10
HOUSING
16
R
METER (CURRENT)
26
26
V
14
IONIZING SOURCE
12
CHAMBER
24
ALARM

IONIZATION TYPE FIRE DETECTOR

This is a continuation of application Ser. No. 096,009 filed Nov. 20, 1979, now abandoned.

BACKGROUND OF THE INVENTION

This invention relates to a detector.

One type of fire detector which is in widespread use is the ionization type fire detector. In a detector of this kind an ionization current is exposed to the atmosphere so that if combustion particles are present in the air these will interfere with the ionization current indicating the outbreak or existence of a fire. Certain fire detectors of this type function by comparing the ionization current to a fixed reference value and, when the ionization current crosses the reference value, initiating an alarm.

In this respect the ionization type fire detector functions satisfactorily. However it is subject to certain disadvantages. For example the ionization current is subject to natural drift caused inter alia by variations in temperature, humidity, and dust, and ageing of the radioactive source which produces the ionization current, and can vary to such an extent under the influence of these natural factors that the alarm threshold is crossed even though there is no fire. In addition the ionization current can be affected by malfunctions in the fire detector. It is also responsive to particles, for example dust particles, which are not necessarily combustion particles. Thus for example particles produced during blasting operations in a mine which settle permanently in the ionization type fire detector can cause false triggering.

The specification of UK Pat. No. 1365018 describes a method of distinguishing certain types of false alarms from genuine fire conditions in a two chamber ionization type fire detector. This specification discloses a fire detector which includes a measuring chamber and reference chamber which are connected in series. A voltage is applied across the two chambers and the potential at a point intermediate the chambers is monitored and analysed to distinguish genuine fire conditions and false alarms.

In a fire detector of this type the reference chamber is saturated with ionization current which is therefore essentially constant. The potential at the intermediate point is consequently dependent on the impedance of the measuring chamber which is in turn affected by the presence of combustion products, dust, etc, but it is also dependent on the magnitude of the ionization current which is determined by the characteristics of the reference chamber.

The ionisation current, however, is the physical quantity which is directly influenced by combustion particles, disturbances due to blasting, moisture, or the like, and it is therefore most desirable to monitor the ionization current directly, and to determine that as far as possible the ionization current is affected only by atmospheric conditions and not by equipment parameter variations, to give the most effective analysis of the operation thereof.

SUMMARY OF THE INVENTION

It is an object of the present invention to provide a detector which can be used as a fire detector, overcoming these problems, and which offers the potential of monitoring currents which are not necessarily related to the outbreak or existence of a fire. This permits the causes of the current variations to be classified into categories which are associated with genuine fire alarm conditions, and false alarm conditions.

The invention provides a detector which includes a housing, a single measuring chamber being formed within the housing, one or more apertures being formed in the wall of the chamber to permit the circulation of air through the chamber, an electrode mounted on an insulating support inside the chamber, means to apply a potential difference between the electrode and the housing, an ionizing source inside the chamber which produces an ionization current which is collected by the electrode, means to amplify the ionization current, and means to provide an indication of the variation with time of the amplified ionisation current.

The indicating means may consist of a device which displays the instantaneous variation of the ionisation current, or the variation of the current over a given time interval. In its simplest form the indicating means consists of an ammeter.

Alternatively the indicating means may consist of a device which records the variation with time of the ionization current.

The recording device may provide a hard copy record, and may for example consist of a chart recorder or similar apparatus. Alternatively the recording device may include a memory as in a microprocessor, mini computer, computer or the like, in which the variation with time of the ionization current is recorded.

Further according to the invention the detector includes means to trigger an alarm if the ionization current crosses a given threshold.

The threshold may be variable.

Alternatively the detector includes means to trigger an alarm if the rate of change of the ionization current exceeds a given rate.

The indicating means may be integral with, or adjacent to, or located remotely from, the detector housing.

The invention also provides a method of operating a detector which produces an ionization current the amplitude of which is influenced by physical factors, the method including the steps of amplifying the current and applying the amplified current to a device which produces a hard copy record of the variation with time of the amplified current.

BRIEF DESCRIPTION OF THE DRAWING

The invention is further described by way of example with reference to the accompanying drawing which is a schematic illustration of a detector according to the invention.

DESCRIPTION OF A PREFERRED EMBODIMENT

The drawing illustrates a detector according to the invention which includes a housing 10 in which is formed a measuring chamber 12, an ionising source 14 such as krypton 85 inside the chamber 12, an electrode 16 which is made of a suitable conductive material and which is supported on an insulating member 18 inside the chamber 12, a differential amplifier 20 connected to the electrode, a current driver 21 connected to the amplifier 20, and a chart recorder 22 and a trigger device 24 connected in parallel to the output of the current driver 21.

The housing 10 is formed with a number of apertures 26 which permit the free passage of air through the chamber 12.

The housing 10 is installed in a suitable location at an area which is to be monitored and which may be remote from a central control point at which the recorder 22 and the alarm trigger device 24 are installed.

The inverting input terminal of the amplifier 20 is connected directly to the electrode 16 and the non-inverting input terminal is connected to a reference voltage, V. The amplifier is connected in a feedback mode by means of a resistor chain which includes a potentiometer R, and the feedback current is compared to and kept equal to the ionization current which flows from the electrode 16. In addition the voltage of the inverting input terminal which is impressed across the chamber 12 is kept constant by virtue of the feedback action of the amplifier.

The feedback current i.e. the ionising current is amplified by the current driver 21 and applied to the chart recorder 22 and the trigger device 24.

The chart recorder 22 therefore records the variation with time of the ionization current. If combustion particles are carried into the chamber 12 by the air the ionization current is reduced, in a known way, and this is recorded by the recorder 22. Similarly any variation of the ionization current produced by any other cause is recorded on the recorder 22. For example if the housing 10 is installed underground in a mine where it is exposed to the products of blasting the ionizaton current will be affected and the change in the current will be recorded. The detector can thus be used to record automatically the times at which blasting takes place.

Should the apertures 26 be blocked for any reason the ionization current will not vary at all and this unusual state of affairs will again be indicated on the recorder 22. Should the detector for any reason malfunction causing the ionisation current to go abnormally high or low or to be invariable, an examination of the chart produced by the recorder 22 will indicate that a fault condition exists and appropriate action can be taken.

The trigger device 24 is a comparator in which the amplified ionisation current is compared to a reference level, and is used to initiate an alarm signal if the ionisation current crosses the reference or threshold level. The threshold value can be fixed or it can be variable so that account is taken of the environmental conditions in which the detector operates. Since the ionization current drifts under the influence of factors such as temperature and humidity variations it is quite possible that the threshold can be crossed even though no combustion, smoke or other particles affect the ionization current. For this reason it is advantageous in certain applications if the trigger device is actuated only when the rate of change of the ionization current exceeds a given rate. In this respect use may be made of any suitable rate of change detection device to trigger an alarm.

In the detector of the invention an analogue output is obtained from the detector and recorded. The recorder functions in parallel with a suitable trigger device. Thus the detector is able to fulfill the roles of fire detection, and of monitoring a given area for certain occurences, and in conjunction with the recorder and trigger level detection equipment the detector is constantly monitored for malfunction.

An analogue record of the ionization current enables a skilled observer, on inspection of the record, to attribute variations in the current to different causes. For example blasting operations in a mine cause the ionization current to vary in a known way. An alarm which is triggered by blasting can then on examination of the record be identified as a false fire alarm. So too a malfunction of the detector which triggers an alarm condition will generally be associated with a current variation which is not associated with a genuine fire alarm condition.

A further advantage of providing a usable analogue signal from the detector arises in that merely by measuring the amplitude of the ionization current with an ammeter it is possible to determine when the operating level of the current has drifted outside acceptable limits, for example due to the accumulation of dust or moisture. The current amplitude can then be adjusted by means of the potentiometer R to bring it within the acceptable limits and so forestall a false alarm signal.

The detector of the invention functions essentially as a constant voltage/variable ionization current device. Since the ionisation current is directly monitored the record produced by variations of the current is precisely related only to atmospheric conditions, or to malfunctions in the detector. The use of the operational amplifier 20 in the manner illustrated carries with it the advantage that the ionization current is interfered with to a minimum extent during the amplification process. A similar result is achieved by employing the operational amplifier to maintain the constant potential in the chamber between the electrode and the ionising source. These two factors help to ensure that fluctuations in the recorded amplified ionization current are due only to ascertainable atmospheric or fire alarm conditions and are not influenced by the amplifying apparatus.

We claim:

1. An ionization type fire detector which includes a single measuring chamber provided with one or more apertures in the wall of the chamber to permit the circulation of air through the chamber, an electrode mounted on an insulating member inside the chamber, means for maintaining constant a potential difference between the electrode and the chamber, an ionizing source inside the chamber which produces an ionization current which is collected by the electrode, means to collect and amplify the ionization current, and indication means to provide an indication of a variation with time of the amplified ionization current.

2. A detector according to claim 1 in which the indicating means comprises a device which displays the instantaneous variation of the ionization current.

3. A detector according to claim 1 in which the indicating means comprises a device which records the variation with time of the ionization current.

4. A detector according to claim 1 in which the detector includes means for generating a trigger signal if the ionization current reached a predetermined value, the trigger signal being suitable for triggering an alarm.

5. A detector according to claim 4 including means to vary said predetermined value.

6. A detector according to claim 1 in which the indicating means is located remotely from the chamber.

7. A method of operating an ionization-type fire detector which includes: providing an ionization source within a chamber in said detector; maintaining a constant potential between the chamber and an electrode mounted therein to cause an ionization current flow, the amplitude of said current being influenced by the presence of ionizing smoke particles; detecting and amplifying the variations of the current generated due to said smoke particles; and applying the amplified current to a device which produces a hard copy record of said variation with time of the amplified current.

* * * * *